US008402694B2

(12) United States Patent
Daumal Castellon

(10) Patent No.: US 8,402,694 B2
(45) Date of Patent: Mar. 26, 2013

(54) SHEAVE SUPPORTING ELEMENT FOR USE IN WINDOW REGULATOR GUIDE SECTIONS

(76) Inventor: Melchor Daumal Castellon, Barcelona (ES)

( * ) Notice: Subject to any disclaimer, the term of this patent is extended or adjusted under 35 U.S.C. 154(b) by 347 days.

(21) Appl. No.: 12/451,905

(22) PCT Filed: Aug. 8, 2007

(86) PCT No.: PCT/ES2007/000484

§ 371 (c)(1),
(2), (4) Date: Dec. 4, 2009

(87) PCT Pub. No.: WO2008/152155

PCT Pub. Date: Dec. 18, 2008

(65) Prior Publication Data

US 2010/0282931 A1 Nov. 11, 2010

(30) Foreign Application Priority Data

Jun. 14, 2007 (ES) ..... 200701275 U

(51) Int. Cl.
*E05F 11/48* (2006.01)

(52) U.S. Cl. ..... 49/352; 49/348; 49/349; 74/505

(58) Field of Classification Search ..... 248/206.2; 49/348, 349, 352
See application file for complete search history.

(56) References Cited

U.S. PATENT DOCUMENTS

| | | | | |
|---|---|---|---|---|
| 4,829,711 | A * | 5/1989 | Sambor | 49/211 |
| 5,309,678 | A * | 5/1994 | Adachi | 49/352 |
| 5,333,411 | A | 8/1994 | Tschirschwitz | |
| 5,367,827 | A * | 11/1994 | Tajima et al. | 49/352 |
| 5,511,443 | A * | 4/1996 | Munekhoff | 74/505 |
| 5,657,580 | A * | 8/1997 | Kobrehel | 49/352 |
| 6,553,718 | B2 * | 4/2003 | Arquevaux et al. | 49/352 |
| 6,758,013 | B2 * | 7/2004 | Staser et al. | 49/352 |
| 6,779,308 | B2 * | 8/2004 | Cabanne et al. | 49/352 |
| 7,121,044 | B2 * | 10/2006 | Santaolalla Gil et al. | 49/352 |
| 7,350,334 | B2 * | 4/2008 | Smith | 49/352 |
| 2003/0140562 | A1 | 7/2003 | Staser et al. | |
| 2004/0187389 | A1 | 9/2004 | Santaolalla et al. | |
| 2006/0037247 | A1 | 2/2006 | Heyer et al. | |
| 2007/0289218 | A1 * | 12/2007 | Castellon | 49/352 |

FOREIGN PATENT DOCUMENTS

| | | |
|---|---|---|
| ES | 2173541 | 10/2002 |
| ES | 2239504 | 9/2005 |
| ES | 2239504 A1 * | 9/2005 |

* cited by examiner

*Primary Examiner* — Terrell McKinnon
*Assistant Examiner* — Daniel J Breslin

(57) ABSTRACT

The invention relates to a supporting element which takes the form of an angle bar. Suitable means are used to provide the bar with a cable guide sheave and the supporting element and the sheave, together with the aforementioned means, are mounted on a guide section of the type used in window regulators. Preferably, a supporting element and a sheave are provided close to each of the ends of the above-mentioned section.

2 Claims, 2 Drawing Sheets

SHEAVE SUPPORTING ELEMENT FOR USE IN WINDOW REGULATOR GUIDE SECTIONS

The present invention relates to a supporting element which takes the form of an angle bar. Suitable means are used to provide the bar with a wire guide sheave; the supporting elements and the sheave, together with the aforementioned means, are mounted on a guide section of the type used in window-regulating devices. Preferably, a supporting element and a sheave are provided close to each of the ends of the aforementioned section.

The supporting element itself is made up of a bar that is preferably metallic, with an angular body, the vertical part being flat, and the upper base being curved, with a central opening in its perimeter, from which a small tab protrudes perpendicular to the vertical part, while the horizontal part is concave.

On the market, there are different types of supports for sheaves that can be considered the state of the art, to fit them into guide sections in window-regulating devices; however, the function is merely that of a supporting element, unlike the supporting element that is the object of the invention, which includes other additional functions, such as:

A stopper for wire covers.

An element for achieving an adjustable position.

A support surface for the sheave.

The sheaves in window regulators lead a wire, which acts as a mechanism for moving the window glass of the automobile. Around the perimeter of the sheave there is a groove that holds and guides this wire. Due to the weight of the glass and its rubbing against the joints in the frame of the window, the sheaves and their turn shaft are subject to a great deal of force, as well as the corresponding wire, which means that a supporting bar or supporting element for the sheave must be very sturdy without increasing its weight very much, and the sheaves must turn with respect to the supporting element and the profile guide, without any play.

In order to fulfil the new functions, the supporting element that is the object of the invention has a ring cup on its vertical part, which serves as a support when the sheave turns, and prevents it from making lateral movements with respect to the supporting element, thus preventing the wire from slipping off the sheave.

On an upper base of a vertical part of the supporting element, as described above, there is a perpendicular tab that, when the supporting element is placed on the guide section of a window regulating device, is entered in one of a plurality of apertures formed in a curved line on the guide section, and the supporting element is placed in the appropriate position in regard to the guide section. Therefore, it should be understood that the supporting element can be placed in a desired position by positioning the tab in an appropriate aperture based on the surrounding conditions and shape of the particular window-regulating device used.

A horizontal part of the supporting element has an essentially concave shape, and includes a pair of openings for the fitting of wire covers therein, so that the horizontal part acts as a stopper for these covers and prevents the dragging of the covers inside towards the wire guide sheave when the wire moves.

The wire guide sheave and the supporting element are attached to the guide section of a window-regulating device by a rivet whose shaft is inserted through a drilled hole in the guide section and riveted at the end, such that the rivet shaft acts as the shaft of the wire guide sheave.

Other details and characteristics shall be shown throughout the description below referring to drawings attached to this report which are shown for illustrative but not limiting purposes a practical embodiment of the invention.

Below is a detailed list of the different parts of the invention which are shown in the figures attached to this report:

(10) supporting element.
(11) wire guide sheave.
(12) drilled hole.
(13) vertical part.
(14) horizontal part.
(15) ring cup.
(16) support surface.
(17) tab.
(18) groove.
(19) openings
(20) rivet.
(21) guide section of a window-regulating device.
(22) line of drilled apertures.
(23) covers.
(24) wires.
(25) drilled hole on the sheave (11).
(26) drilled hole on the guide section (21).

DESCRIPTION OF THE PREFERRED EMBODIMENTS

Figure 1:
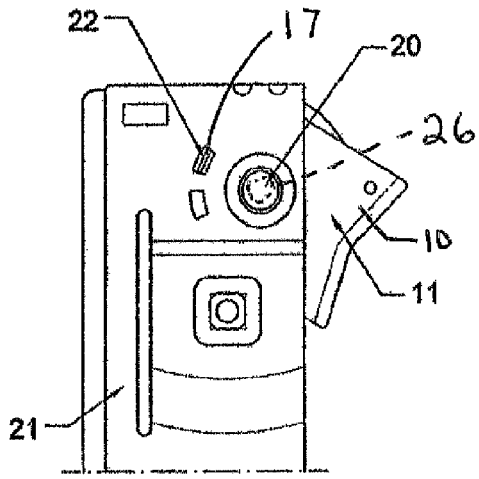
FIG. 1 is a partial back elevation view of a guide section (21) of a window-regulating device, to which a supporting element (10) and a wire guide sheave (11) of the present invention are assembled using a rivet (20) deformed at a back side of the guide section.
Figure 2:
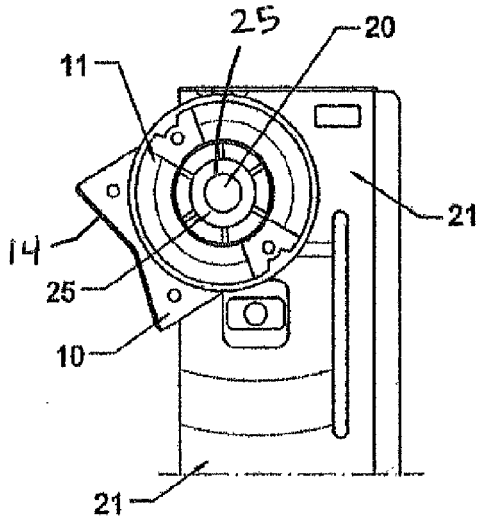
FIG. 2 is a partial front elevation view of a guide section (21) of a window-regulating device, to which the supporting element (10) and the wire guide sheave (11) are assembled using a rivet (20) deformed at a front side of the supporting element (10).
Figure 3:
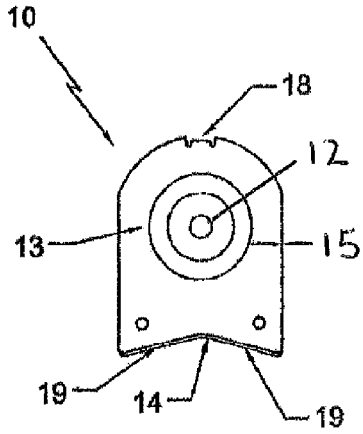
FIG. 3 is a front elevation view of the supporting element (10).
Figure 4:
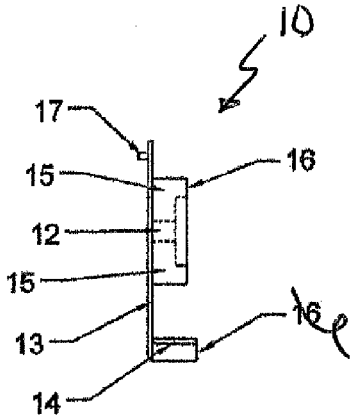
FIG. 4 is a side elevation view of the supporting element (10).
Figure 5:
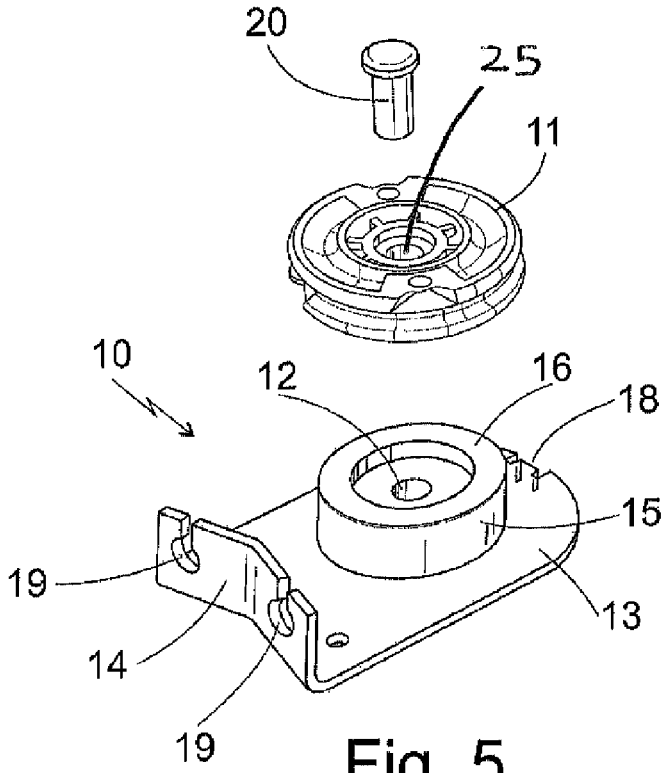
FIG. 5 is an exploded view of the wire guide sheave (11) and supporting element (10) of FIG. 2.
Figure 6:
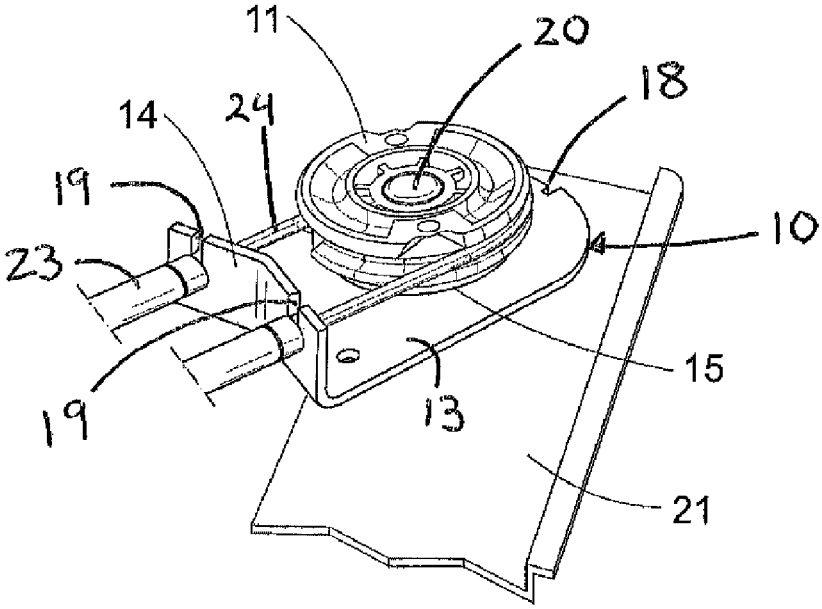
FIG. 6 is a front perspective view of a supporting element fixed to a guide section via a rivet shaft.

In one of the preferred forms of the device that is the object of the present invention, and as can be seen in FIGS. 3 and 4, the supporting element (10) has a vertical part (13) that is noticeably flat, and that includes a ring cup (15) extending therefrom, the central part of which includes a drilled hole (12) for the housing of the shaft of rivet (20).

An upper base portion of a flat part of the supporting element 10 has a semi-circular configuration, and in its central part, there is a groove (18. A tab (17) sticks out perpendicularly from the aforementioned flat part (13), and fits within one of a line of drilled holes (22 extending through the guide section (21).

The horizontal part (14) of the supporting element (10), as can be seen in FIGS. 3-6, is in the shape of a substantially convex plane that has some openings (19) into which the ends of the covers (23) of the wires (24) fit.

The alignment and orientation of the supporting element (10) comes from the combination of the tab (17) with the aforementioned line of drilled holes (22) placed in the guide section (21).

The joining of the supporting element (10) to the guide section (21) comes from the shaft of rivet (20), which crosses the drilled hole (12) of (10) and the drilled hole (25) in the wire guide sheave (11), so that the supporting element (10) is fixed to the guide section (21), but the sheave (11) may turn freely around the shaft of the rivet (20).

The prevision of a cup (15) in the vertical part (13) of the supporting element (10) assures a gentle rubbing against the lateral surface of the sheave (11), so that said lateral surface of (11) rests on the top support surface (16) of the cup (15), ensuring that there is not any play. Having sufficiently described this invention using the Figures attached, it is easy to understand that any changes judged to be suitable may be made, whenever these changes do not alter of the essence of the invention summarised in the following claims.

The invention claimed is:

1. A sheaf supporting element for use in a vehicle window regulator comprising:

a supporting element in the form of a metal bar including:

a substantially flat vertical part with a curved upper base, the curved upper base including a central groove formed in a perimeter thereof, a tab protruding perpendicular from the upper base of the vertical part, a horizontal part extending perpendicular from a lower portion of the vertical part, wherein the horizontal part has an essentially convex shape and includes spaced openings therein adapted to receive respective wire covers, and a ring cup extending from the vertical part, the ring cup including a hole extending there through adapted to receive a rivet shaft; and a wire guide sheave including a hole extending through a central part of the wire guide, the wire guide sheave mounted to the supporting element such that a surface of the wire guide sheave rests against a surface of the ring cup;

wherein the tab is adapted to extend through one or more holes in a guide section of a window regulating device such that the position of the sheaf supporting element relative to a guide section of a window regulating device is adjustable.

2. A window regulating device comprising:

a guide section for a vehicle window regulator, the guide section including a hole there through;

a supporting element in the form of a metal bar including:

a substantially flat vertical part with a curved upper base, the curved upper base including a central groove formed in a perimeter thereof, a tab protruding perpendicular from the upper base of the vertical part, a horizontal part extending perpendicular from a lower portion of the vertical part, wherein the horizontal part has an essentially convex shape and includes spaced openings therein adapted to receive respective wire covers, and a ring cup extending from the vertical part, the ring cup including a hole extending there through adapted to receive a rivet shaft;

a wire guide sheave including a hole extending through a central part of the wire guide sheave, the wire guide sheave being mounted to the supporting element such that a surface of the wire guide sheave rests against a surface of the ring cup; and a rivet with a shaft, the shaft extending through the hole in the wire guide sheave, the hole in the ring cup, and the hole in the guide section, to secure the supporting element and wire guide sheave to the guide section;

wherein the tab extends through a selected one of a plurality of apertures in the guide section, and the position of the sheaf supporting element relative to the guide section can be altered by moving the tab into a different one of the plurality of apertures.

* * * * *